United States Patent [19]

Farrell et al.

[11] Patent Number: 4,938,438

[45] Date of Patent: Jul. 3, 1990

[54] RAILROAD SWITCH STAND

[75] Inventors: Arthur W. Farrell, Naperville; James A. Remington, Richton Park; Albert V. Fiorenzo, South Chicago Heights, all of Ill.; Ray Hoyer, St. John, Ind.

[73] Assignee: ABC Rail Corporation, Chicago, Ill.

[21] Appl. No.: 294,423

[22] Filed: Jan. 9, 1989

[51] Int. Cl.[5] ..... B61L 5/02

[52] U.S. Cl. ..... 246/406; 246/489

[58] Field of Search ..... 246/393, 401, 402, 406, 246/407, 410, 412, 413, 414, 143, 147, 484, 136, 405, 409

[56] References Cited

U.S. PATENT DOCUMENTS

| | | | |
|---|---|---|---|
| 411,998 | 10/1889 | Newman | 246/412 |
| 531,238 | 12/1894 | Warren | 246/402 |
| 925,345 | 6/1909 | Keeran | 246/489 |
| 1,366,350 | 1/1921 | Beil | 246/393 |
| 1,380,037 | 5/1921 | Breed | 246/393 |
| 1,763,530 | 6/1930 | Latty | 246/489 |
| 4,337,914 | 7/1982 | Rich | 246/393 |
| 4,824,054 | 4/1989 | Kohake et al. | 246/406 |

*Primary Examiner*—Douglas C. Butler
*Assistant Examiner*—Mark T. Le
*Attorney, Agent, or Firm*—Thomas S. Baker, Jr.

[57] ABSTRACT

A railroad switch stand for moving switch points between a pair of stock rails having a worm and gear drive connection between an operator driven input shaft and an output shaft connected to the switch points.

9 Claims, 4 Drawing Sheets

RAILROAD SWITCH STAND

BACKGROUND OF THE INVENTION

A switch stand operates to move a pair of switch points between two (2) stock rails to divert rolling stock from one track to another. A typical switch stand consists essentially of a base, a spindle and a throwing lever. The switch points are moved between the stock rails by moving the throwing lever through part of a circle in a horizontal plane to impart directly a rotary motion to the spindle. A crank on the foot of the spindle serves to convert the rotary motion of the spindle into rectilinear movement of a connecting rod attached to a switch rod mounted between the switch points. Thus, movement of the throwing lever by an operator from one to another of the two operating positions for the switch stand causes corresponding movement of the switch points from one stock rail to another.

In recent times there has been a dramatic increase in federal employee liability actions for alleged back injuries resulting from the exertion of heavy forces to operate throwing lever style switch stands. Over the years the force requirements to operate switch stands have increased substantially. These increased force requirements have been caused by the weight of rail sections increasing from between eighty and ninety pounds per yard to a range of one hundred thirty-two to one hundred thirty-six pounds per yard now in common usage. Additionally, speeds of trains through turnouts have increased requiring the use of longer turnout configurations which in turn have required longer, heavier switch points. Furthermore, with the combination of heavier rail sections and longer switch points, the frictional forces within switch points have increased, again causing the force requirements to operate a switch stand to increase.

It has been found that track equipment has been less well maintained and adjusted in recent times which also contributes to the increased force requirements required to operate switch stands. A situation further compounding the problem of back injuries occurring during operation of switch stands has been the decline of experienced railroad personnel necessitating the use of less experienced people operating switch stands.

In order to reduce the incidents of federal employee liability cases alleging back injuries occurring during operation of switch stands, railroads have begun to demand switch stands requiring less operator force for operation. Existing manual lever switch stands have mechanical advantages in the range of six to seven. A mechanical advantage of six has been a recommended minimum by the American Railway Engineering Association based upon an average load of eight hundred sixty-four pounds of force required to move a pair of switch points. With this criterion a theoretical operator force of up to one hundred forty-four pounds may be required to be exerted to operate a switch stand between its two operating positions. In practice, current switch stands have been found to have a mechanical advantage of approximately nine to one. Such stands require a manual force by an operator of approximately ninety-six pounds for operation.

Preferably a switch stand would incorporate a large mechanical advantage to thereby require a minimum manual force to be applied by an operator to move a switch stand from one operating position to another. Such a switch stand also should be self-locking in each operating position, should have a stop to prevent further spindle movement for each operating position and should provide an easily replaceable part designed to fail during accidental "trail-through" to protect internal components of the switch stand from damage.

SUMMARY OF THE INVENTION

The present invention provides a switch stand assembly for moving a connecting rod attached to a switch rod mounted between a pair of switch points that are positioned between a pair of stock rails to divert rolling stock from one track to another. The switch stand includes a vertically extending body tube and a spindle rotatably mounted within the body tube and pivotal between a first position in which the connecting rod is extended in one direction to move the switch points such that one point rests against one stock rail and a second position in which the connecting rod is extended in a second direction to move the switch points such that the other point rests against the second stock rail. A crank is connected to the foot end of the spindle and to the connecting rod and a worm gear is connected to the head end of the spindle. The switch stand further includes a horizontally extending input shaft mounted in the body tube. A worm wheel is mounted on the input shaft in engagement with the worm gear such that rotary motion of the input shaft causes corresponding rotary motion of the worm gear, the spindle and the crank to thereby impart substantially linear movement to the connecting rod for movement of the switch points.

DESCRIPTION OF THE PREFERRED EMBODIMENT

Figure 1:
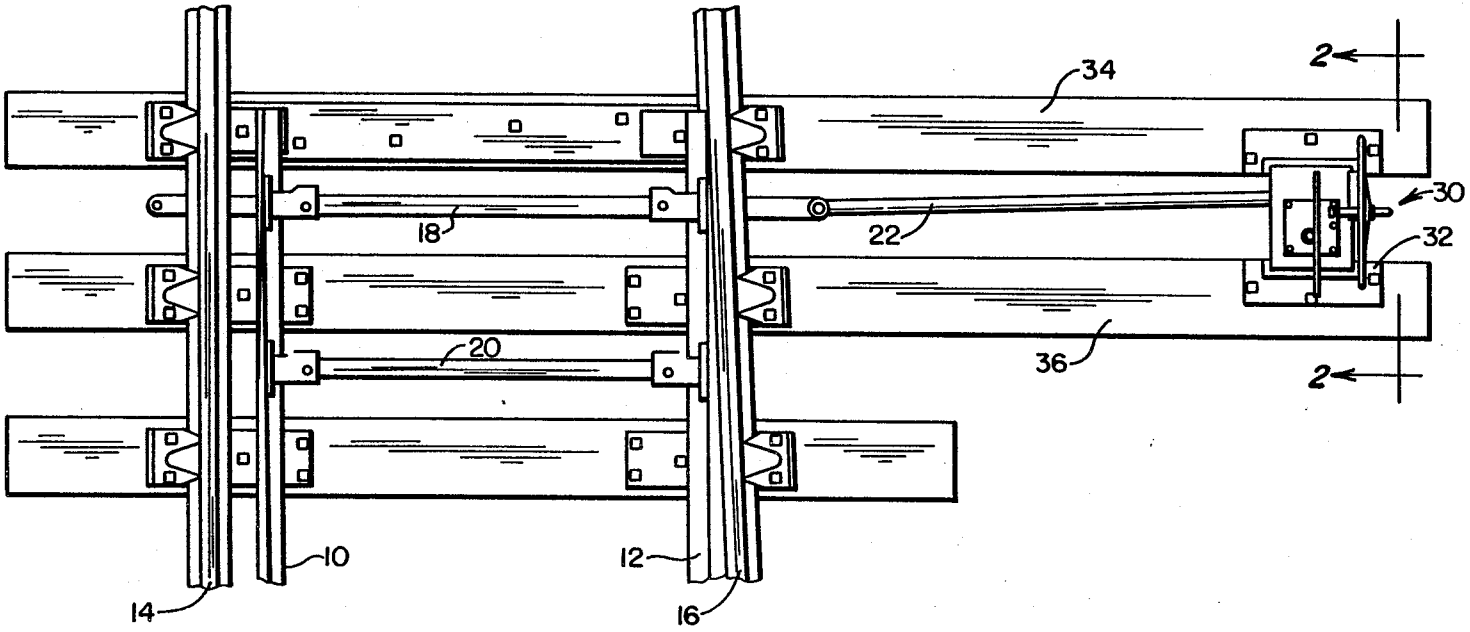
FIG. 1 is a plan view of a pair of stock rails and a pair of switch points illustrating the connection of the switch points to a switch stand via a connecting rod.

Turning to FIG. 1 of the drawings, it may be observed that a pair of switch points (10 and 12) lie between a pair of stock rails (14 and 16). The switch points (10 and 12) are connected by a pair of laterally extending switch rods (18 and 20). A connecting rod (22) serves to connect the front switch rod (18) to a switch stand (30). The switch stand (30) has a base (32) which mounts the stand on a pair of adjacent railroad ties (34 and 36). In the operating position of switch stand (30) depicted in FIG. 1, the switch point (12) rests against the stock rail (16). Upon operation of the switch stand (30) to its second operating position the connecting rod (22) and the switch rod (18) are moved to the left such that the switch point (10) lies adjacent the stock rail (14). Thus, it may be seen that operation of switch stand (30) between its two operating positions causes the connecting rod (22) to be extended in one direction to move switch rod (18) and switch points (10 and 12) from a position in which one switch point lies against one stock rail to a position in which the opposite switch point lies against the opposite stock rail.

Figure 3:
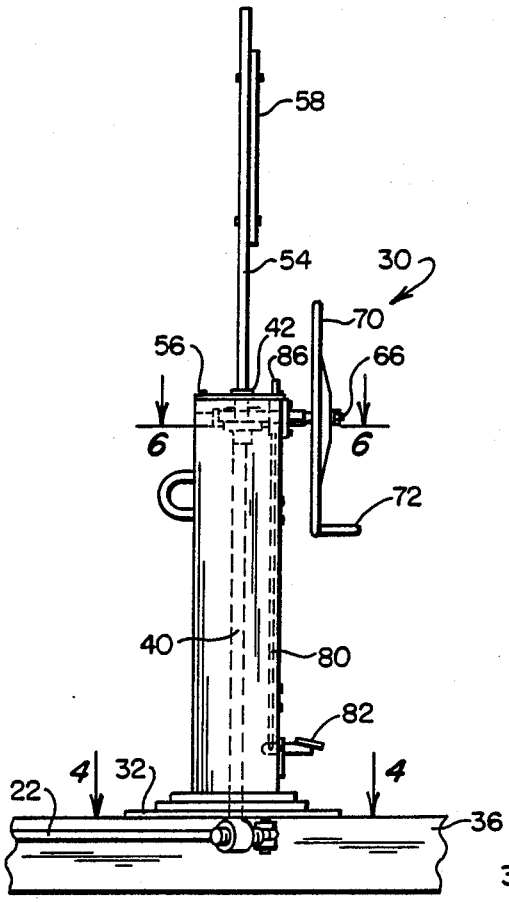
FIG. 3 is a side view looking from the left of the switch stand illustrated in FIG. 2.
Figure 2:
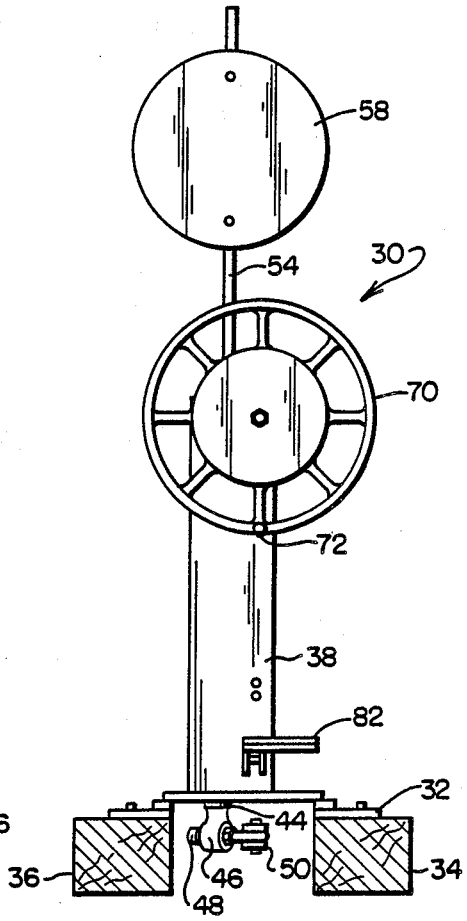
FIG. 2 is a view along line 2—2 of FIG. 1.
Figure 4:
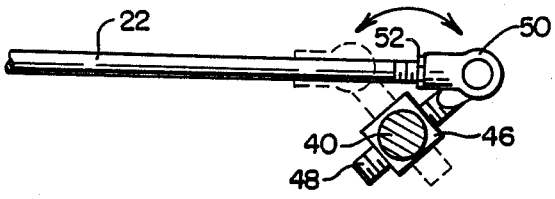
FIG. 4 is a view along line 4—4 of FIG. 3.

Referring to FIGS. 2 and 3, it may be observed that switch stand (30) includes a body tube (38) which extends vertically upwardly from base (32). A longitudinally extending spindle (40) is mounted rotatably within spindle bushings (42 and 44) at the head and foot ends respectively of the body tube (38). The foot end of spindle (40) terminates in a crank (46) having a threaded bore which receives a threaded rod (48) pivotally connected to a clevis (50) threaded onto one end of connecting rod (22) as shown in FIG. 4. Rotation of crank (46) on threaded rod (48) and rotation of clevis (50) on the threaded end of connecting rod (22) adjusts the amount of rectilinear movement of connecting rod (22) between the two operating positions for the switch stand (30) to thereby define the throw of the switch points (10 and 12). A jam nut (52) locks clevis (50) onto the end of connecting rod (22). Turning again to FIGS. 2 and 3, a mast (54) attached to the head end of spindle (40) projects upwardly through an opening, not shown, in a cover plate (56) which closes the top end of body tube (38). A target (58) is rigidly affixed to mast (54). Accordingly, mast (54) and target (58) rotate with spindle (40) between the two operating positions of switch stand (30) to provide a visual indication as to the set position of the switch stand (30).

Figure 5:
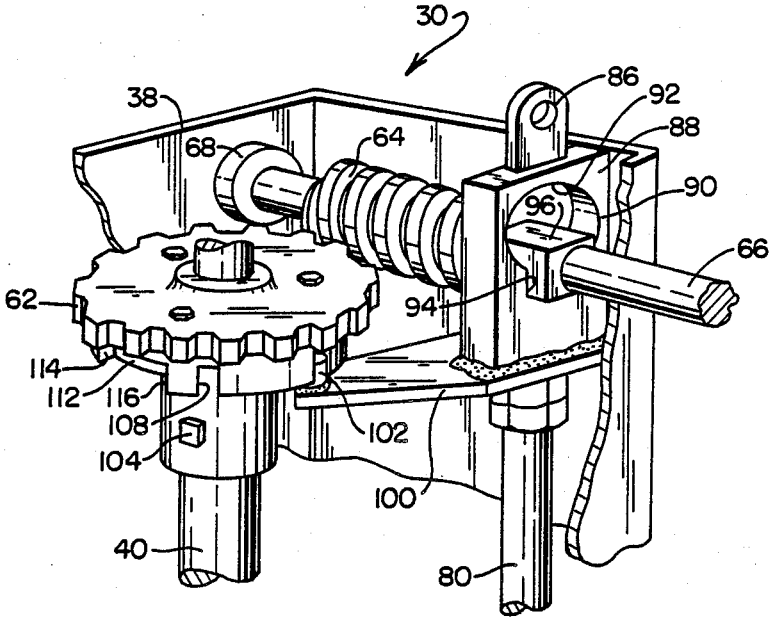
FIG. 5 is a perspective view of the components enclosed within the upper portion of the switch stand body tube with the cover plate removed.

The operating mechanism of switch stand (30) may be seen by referring to FIG. 5. A worm gear (62) is mounted on spindle (40) just beneath cover plate (56). Worm gear (62) engages a worm wheel (64) mounted on an input shaft (66) supported in a horizontal plane in a pair of guides (68) one of which is shown, welded to body tube (38). Referring again to FIGS. 2 and 3, it may be seen that a hand wheel (70) having a laterally projecting knob (72) mounts at one end of input shaft (66). Rotation of hand wheel (70) causes rotation of input shaft (66) and worm wheel (64) which in turn causes rotation of worm gear (62) and spindle (40) as may be seen in FIG. 5.

As mentioned above, the switch stand (30) has two operating positions. In one operating position switch point (10) rests against stock rail (14) and in the other operating position switch point (12) rests against stock rail (16). Switch stand (30) is operated only when the switch points (10 and 12) are to be moved from one position to another. During the time the switch stand (30) resides in one operating position or the other a locking mechanism ensures that unintended rotation of hand wheel (70), input shaft (66) and spindle (40) cannot occur. The lock mechanism retains switch stand (30) in one or the other of its operating positions. This locking mechanism must be moved to an unlocked position in order to operate the hand wheel (70) and input shaft (66) for movement of the switch stand (30) between its two operating positions.

The operating mechanism includes a lock rod (80) which extends vertically upward through body tube (38) parallel with spindle (40). Looking again to FIG. 3, it may be seen that a foot pedal (82) attaches to the lower end of lock rod (80) and that a spring (84) acts to bias lock rod upwardly within body tube (38). A lock block (88) attaches to the upper end of lock rod (80) and mounts lock eye (86) which projects upwardly through an opening, not shown, in cover plate (56) as may be seen by looking to FIG. 5. Lock block (88) contains a keyhole shaped opening (90) which receives one end of input shaft (66). The keyhole shaped opening (90) includes a circular portion (92) and a square portion (94) which receives a square section (96) of input shaft (66). In the lock rod position illustrated in FIG. 5, the square section (96) of input shaft (66) rests within the square portion (94) of keyhole shaped opening (90) which locks input shaft (66) against rotation. This constitutes the locked position of lock rod (80) in which lock eye (86) projects upwardly above cover plate (56) and a paddle lock may be received therein to prevent downward movement of lock rod (80) to an unlocked position.

When rotation of input shaft (66) becomes necessary to enable switch stand (30) to move from one operating position to another the locking means is removed from lock eye (86) and foot pedal (82) is depressed to move the lock rod (80) downwardly within body tube (38) to where the square section (96) of input shaft (66) resides within the circular portion (92) of keyhole shaped opening (90). In this position input shaft (66) may be rotated freely by movement of hand wheel (70). In the present invention, it has been found advantageous to size worm wheel (64) and worm gear (62) such that five complete rotations of hand wheel (70) and input shaft (66) cause the switch stand (30) to move between its two operating positions.

Figure 6:
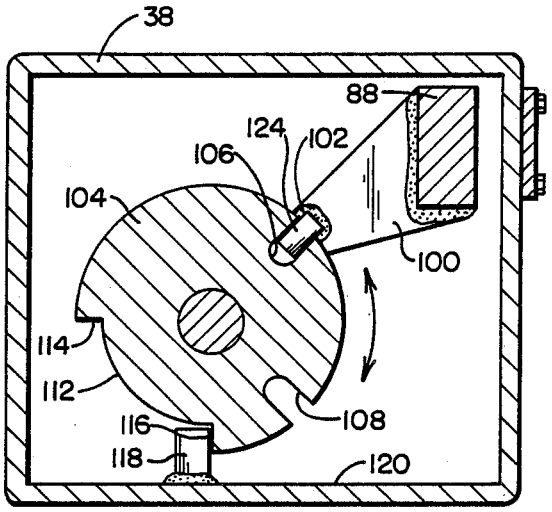
FIG. 6 is a view along line 6—6 of FIG. 3.

Turning again to FIG. 5, it may be observed that a horizontally extending lock arm (100) having a vertically upwardly projecting lock tab (102) attaches to the bottom of lock block (88). An index hub (104) mounts on spindle (40) just below worm gear (62). Hub (104) contains a first lock slot (106) and a second lock slot (108) one of which receives lock tab (102) when the switch stand (30) resides in one of its two operating positions. Index hub (104) further contains a stop slot (112) having a pair of stop surfaces (114 and 116) best seen in FIG. 6. The stop surfaces (114 and 116) are engaged by a spindle stop (118) rigidly affixed to an inner wall (120) of body tube (38). When the switch stand (30) has been placed in one operating position in which switch point (12) rests against stock rail (16) lock tab (102) resides within lock slot (112) and stop member (116) rests against spindle stop (118).

In order to operate switch stand (30) to the other operating position such that switch point (10) rests against stock rail (14), the foot pedal (82) illustrated in FIG. 3 must be depressed to move lock rod (80) vertically downwardly within body tube (38) such that the square section (96) of input shaft (66) rests within the circular portion (92) of lock block (88). Thereafter, hand wheel (70) attached to input shaft (66) must be rotated five complete turns to cause worm gear (62) and spindle shaft (40) to rotate counterclockwise to where spindle stop (118) rests against stop surface (114) and lock tab (102) resides within the second lock slot (108). As worm wheel (64), index hub (104) and worm gear (62) cause spindle (40) to rotate from one operating position to another the top surface (124) of lock tab (102) rides against the bottom rim of index hub (104). At the same time that spindle stop (118) engages one of the stop surfaces (114 and 116) the lock tab (102) will pop upwardly into one of the lock slots (106 and 108) under the action of spring (84) at the bottom of lock rod (80). In other words, spindle stop (118) and lock tab (102) work simultaneously to stop rotation of index hub (104) and spindle (40).

Turning to FIG. 4, it may be observed that counterclockwise rotation of worm gear (62), index hub (104) and spindle (40) in which lock tab (102) moves from lock slot (106) to lock slot (108) will cause connecting rod (22) to move from the position in which switch point (12) engages stock rail (16) to the second position in which switch point (10) engages stock rail (14). The throw or movement of connecting rod (22) may be adjusted by rotating clevis (50) on the threaded end of connecting rod (22) and turning threaded rod (48) within the threaded portion of crank (46). Additionally, it has been found advantageous to size crank (46), rod (48) and clevis (50) such that one of these elements will fail in the event a train "trails-through" the switch to thereby protect the major components of the switch stand.

Figure 7:
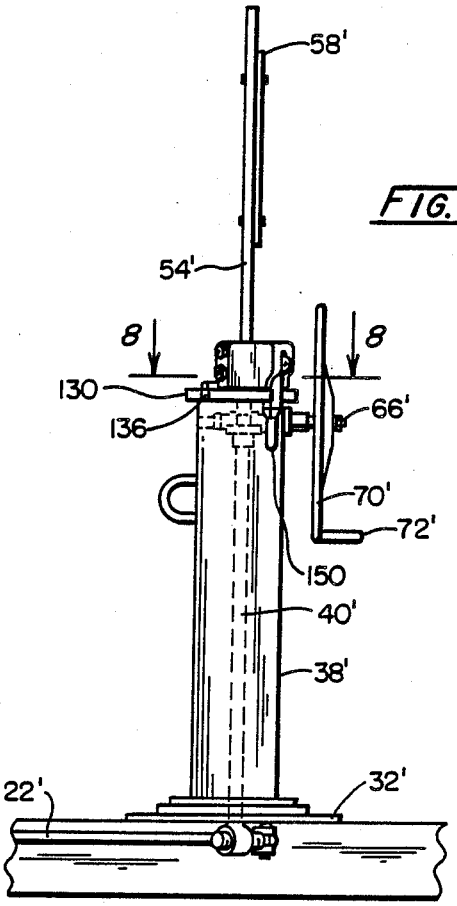
FIG. 7 is a view of a second embodiment of the present invention which incorporates a hand lever.
Figure 8:
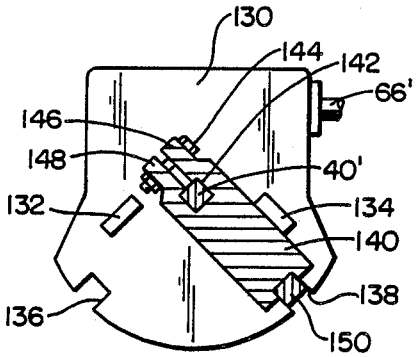
FIG. 8 is a view along line 8—8 of FIG. 7.

A second embodiment of the present invention may be seen by referring to FIGS. 7 and 8. This embodiment includes the same basic operating system of a hand wheel, input shaft, worm wheel and worm gear to rotate a spindle and thereby cause rectilinear movement of a connecting rod as in the first embodiment and identical elements are identified by identical primed numbers. The difference between this latter embodiment and the former embodiment resides in the locking mechanism utilized to retain the switch stand (30) in one of its two operating positions. In this second embodiment a modified cover plate (130) is mounted on the top of body tube (38'). Cover plate (130) includes a pair of lever stops (132 and 134) which project upwardly from the top surface of the cover plate and a pair of lever slots (136 and 138) which are formed in one side of the cover plate (130). A lever bracket (140) having a square throat (142) engages a complimentary shaped portion of spindle (40'). A nut and bolt assembly (144) clamps a pair of arms (146 and 148) at one end of lever bracket (140) onto spindle (40'). A hand lever (150) attaches pivotally to the outer end of lever bracket (140).

In one operating position of switch stand (30) lever (150) projects vertically downwardly perpendicular to lever bracket (140 ) and is received with in hand lever slot (138). Simultaneously, hand lever bracket (140) rests against lever stop (134). In the other operating position of switch stand (30), lever (150) extends vertically downwardly perpendicular to lever bracket (140) and is received within lever slot (136). Simultaneously, lever bracket (140) rests against lever stop (132). When a switchman operates switch stand (30) from one operating position to another lever (150) must be pivoted upwardly out of lever slot (138) to a horizontal position to enable hand wheel (70') to be rotated. As hand wheel (70') and input shaft (66') rotate, lever bracket (140) and hand lever (150) slide across the top surface of cover plate (130). When the switch stand (30) has attained the second operating position, lever bracket (140) strikes lever stop (132) and hand lever (150) drops into lever slot (136) to thereby provide a positive stop for the switch stand. Although not shown, a locking device may be utilized to retain hand lever (150) in each of the two locked positions.

It has been found that utilizing the worm gear and worm wheel drive mechanism of the subject invention to rotate the spindle and to drive a connecting rod a mechanical advantage of approximately seventy will be obtained. Consequently, the manual force required to move the switch stand between its two operating positions amounts to between twelve and thirteen pounds. Additionally, because of the flywheel effect of the hand wheel (70) during rotation, the actual force required to operate the switch stand drops further to a range of between seven and ten pounds.

From the above, it may be seen that the worm gear and worm wheel drive mechanism of the present invention to rotate a switch stand spindle reduces the force required to operate the stand by a factor of approximately eight as opposed to a conventional switch stand and thereby almost completely eliminates the chance of an operator back injury occurring during operation of the switch stand. An additional advantage of the present invention resides in the fact that the hand wheel (70) may be removed from the input shaft (66) to permit the installation of an electric, pneumatic or hydraulic motor for automatic operation of the switch stand.

Since certain changes may be made to the above-described apparatus, system and method without departing from the scope of the invention herein, it is intended that all matter contained in the description thereof or shown in the accompanying drawings shall in interpreted as illustrative and not in a limiting sense.

We claim:

1. A switch stand assembly for moving a connecting rod attached to a switch rod mounted between a pair of switch points located between a pair of stock rails to divert rolling stock from one track to another comprising:

a vertically extending body tube;

a spindle rotatably mounted within said body tube and pivotable between a first position in which said connecting rod is extended in one direction to move said switch points such that one point rests against one stock rail and a second position in which said connecting rod is extended in a second direction to move said switch points such that the other point rests against the second stock rail;

a crank connected to the foot end of said spindle and to the connecting rod;

a worm gear connected to the head end of said spindle;

a horizontally extending input shaft mounted in said body tube;

a worm wheel mounted on said input shaft and in engagement with said worm gear such that rotary motion of said input shaft causes corresponding rotary motion of said worm gear, said spindle and said crank to thereby impart substantially linear movement to said connecting rod for movement of said switch points;

an index hub affixed to said spindle having a stop slot defining a first stop surface and a second stop surface;

a spindle stop mounted on said body tube;

wherein said spindle stop engages said first stop surface when said spindle is at said first position and engages said second stop surface when said spindle is at said second position;

a stop block mounted on said input shaft and rotatable therewith;

a lock rod mounted for vertical movement between a locked position and an unlocked position within said body tube;

a lock block affixed to said lock rod;

a keyhole formed in said lock block having a first portion for non-rotatably receiving said stop block to prevent rotation thereof and a second portion for rotatably receiving said stop block to permit rotation thereof;

wherein said stop block is captured within said first portion of said keyhole when said lock rod is in said locked position and said stop block is within said second portion to enable said input shaft to rotate when said lock rod is in said unlocked position; and moving means for moving said lock rod between said locked and said unlocked positions.

2. The switch stand assembly of claim 1, in which a first lock slot and a second lock slot are formed in said index hub; and a lock tab resides within said first lock slot when said spindle is at said first position and said lock tab resides within said second lock slot when said spindle is at said second position.

3. A switch stand assembly for moving a connecting rod attached to a switch rod mounted between a pair of switch points located between a pair of stock rails to divert rolling stock from one track to another comprising:

a vertically extending body tube;

a spindle rotatably mounted within said body tube and pivotable between a first position in which said connecting rod is extended in one direction to move said switch points such that one point rests against one stock rail and a second position in which said connecting rod is extended in a second direction to move said switch points such that the other point rests against the second stock rail;

a crank connected to the foot end of said spindle and to the connecting rod;

a worm gear connected to the head end of said spindle;

a horizontally extending input shaft mounted in said body tube;

a worm wheel mounted on said input shaft and in engagement with said worm gear such that rotary motion of said input shaft causes corresponding rotary motion of said worm gear, said spindle and said crank to thereby impart substantially linear movement to said connecting rod for movement of said switch points;

an index hub affixed to said spindle having a stop slot defining a first stop surface and a second stop surface;

a spindle stop mounted on said body tube; and wherein said spindle stop engages said first stop surface when said spindle is at said first position and engages said second stop surface when said spindle is at said second position.

4. The switch stand assembly of claim 3, in which a first lock slot and a second lock slot are formed in said index hub; and a lock tab resides within said first lock slot when said spindle is at said said first position and said lock tab resides within said second lock slot when said spindle is at said second position.

5. A switch stand assembly for moving a connecting rod attached to a switch rod mounted between a pair of switch points located between a pair of stock rails to divert rolling stock from one track to another comprising:

a vertically extending body tube;

a spindle rotatably mounted within said body tube and pivotable between a first position in which said connecting rod is extended in one direction to move said switch points such that one point rests against one stock rail and a second position in which said connecting rod is extended in a second direction to move said switch points such that the other point rests against the second stock rail;

a crank connected to the foot end of said spindle and to the connecting rod;

a worm gear connected to the head end of said spindle;

a horizontally extending input shaft mounted in said body tube;

a worm wheel mounted on said input shaft and in engagement with said worm gear such that rotary motion of said input shaft causes corresponding rotary motion of said worm gear, said spindle and said crank to thereby impart substantially linear movement to said connecting rod for movement of said switch points;

a stop block mounted on said input shaft and rotatable therewith;

a lock rod mounted for vertical movement between a locked position and an unlocked position within said body tube;

a lock block affixed to said lock rod;

a keyhole formed in said lock block having a first portion for non-rotatably receiving said stop block to prevent rotation thereof and a second portion for rotatably receiving said stop block to permit rotation thereof;

wherein said stop block is captured within said first portion of said keyhole when said lock rod is in said locked position and said stop is within said second portion to enable said input shaft to rotate when said lock rod is in said unlocked position; and moving means for moving said lock rod between said locked and said unlocked positions.

6. The switch stand of claim 5 in which said moving means includes a foot pedal.

7. The switch stand of claim 5 further comprising:

a cover plate for said body tube;

a bore formed in said cover plate;

a lock eye formed in said lock rod; and wherein said lock eye projects through said cover plate bore when said lock rod is in said locked position.

8. A switch stand assembly for moving a connecting rod attached to a switch rod mounted between a pair of switch points located between a pair of stock rails to divert rolling stock from one track to another comprising:

a vertically extending body tube;

a spindle rotatably mounted within said body tube and pivotable between a first position in which said connecting rod is extended in one direction to move said switch points such that one point rests against one stock rail and a second position in which said connecting rod is extended in a second direction to move said switch points such that the other point rests against the second stock rail;

a crank connected to the foot end of said spindle and to the connecting rod;

a worm gear connected to the head end of said spindle;

a horizontally extending input shaft mounted in said body tube;

a worm wheel mounted on said input shaft and in engagement with said worm gear such that rotary motion of said input shaft causes corresponding rotary motion of said worm gear, said spindle and said crank to thereby impart substantially linear movement to said connecting rod for movement of said switch points;

a cover plate for said body tube;

a first stop member on said cover plate and a second stop member mounted on said cover plate;

a lever bracket attached to said spindle; and wherein said lever bracket engages said first stop member when said spindle is in said first position and said lever bracket engages said second stop member when said spindle is in said second position.

9. The switch stand assembly of claim 8 further comprising:

a hand lever connected to said lever bracket;

wherein a first hand lever slot and a second hand lever slot are formed on said cover plate; and wherein said hand lever is received within said first hand lever slot when said spindle is in said first position and said hand lever is received within said second hand lever slot when said spindle is in said second position.

* * * * *